US006561205B1

(12) United States Patent
Chen

(10) Patent No.: US 6,561,205 B1
(45) Date of Patent: May 13, 2003

(54) CONTROL MECHANISM FOR FOLDING JUMP UMBRELLAS

(76) Inventor: Tien-Cheng Chen, No. 118, Sec. 2, Chang-Tsao Rd., He-Mei Chen, Changhua Hsien (TW)

( * ) Notice: Subject to any disclaimer, the term of this patent is extended or adjusted under 35 U.S.C. 154(b) by 56 days.

(21) Appl. No.: 09/968,785

(22) Filed: Oct. 3, 2001

(51) Int. Cl.[7] ..... A45B 25/14
(52) U.S. Cl. ..... 135/24; 135/22
(58) Field of Search ..... 135/24, 22

(56) References Cited

U.S. PATENT DOCUMENTS 6,257,257 B1 * 7/2001 Shih ..... 135/24

* cited by examiner

*Primary Examiner*—Robert Canfield
(74) *Attorney, Agent, or Firm*—Bacon & Thomas, PLLC

(57) ABSTRACT

A control mechanism for folding jump umbrellas includes a composite control ring, a lower runner having a step opening at one end for housing a lower runner spring and a sleeve and a square opening engageable with a latch stub of a pushbutton. When the pushbutton is depressed, the square opening will be separated from the latch stub to allow the umbrella frame extending under the force of an extension spring. To retract the umbrella, depress a clip leg to move a latch element away from the harness of an elastic latch strip, the umbrella may be retracted by a retracting spring. When the umbrella tie band is not unfastened and the pushbutton is incidentally triggered, the lower runner spring which has a greater elastic force than a control ring spring will prevent the clip leg from reaching the position of the latch element, and the umbrella will not be extended or retracted immediately. Thus the umbrella can be prevented from extending by incidental triggering of the pushbutton.

15 Claims, 7 Drawing Sheets

CONTROL MECHANISM FOR FOLDING JUMP UMBRELLAS

FIELD OF THE INVENTION

The present invention relates to a control mechanism for folding jump umbrellas and particularly a mechanism that employs the design of pushbutton and springs to extend and retract folding umbrellas.

BACKGROUND OF THE INVENTION

Weather conditions often are unpredictable and capricious, and may change swiftly in a short time. To guard people from sudden rain fall, various types of automatic jump umbrellas have been developed and introduced on the market.

FIG. 1 illustrates a conventional jump umbrella which includes a pushbutton 1 to depress a hook blade 11 through a press plate for releasing the umbrella frame to extend the umbrella when in use. When to retract the umbrella, depress the pushbutton 1 to make the press plate releasing a latch element 12 which is fastened to cord such that the spring located on the umbrella frame will pull the umbrella in a folding state. However when the umbrella is being tied by a tie band, the umbrella frame could be abruptly extended by incidentally triggering the pushbutton 1. It even has the risk of hurting people. Hence to develop a more secured mechanism to prevent the umbrella frame from incidental extending is an issue remained to be resolved.

SUMMARY OF THE INVENTION

The primary object of the invention is to resolve the foregoing disadvantages. The invention aims to provide a control mechanism for automatic extending and retracting folding jump umbrellas. The control mechanism of the invention employs a pushbutton which may be depressed to release a lower runner from a latch stub of the pushbutton and allows an extension spring to move the lower runner towards the umbrella frame, and allows a clip leg of a control ring reaching the position of a latch element for extending the umbrella.

Another object of the invention is to provide a control mechanism that utilizes the pushbutton to depress the clip leg so that the latch element can be released from the harness of an elastic latch strip and disengages from a control means to allows the umbrella retracting under a retracting spring.

A further object of the invention is to provide a control mechanism that has a lower runner spring with a greater spring force than a control ring spring such that when the pushbutton is incidentally triggered while the tie band of the umbrella is fastened, the clip leg will be restrained from moving to the position of the latch element, and the umbrella frame will be not fully extended even the pushbutton is depressed.

Yet another object of the invention is to provide a control mechanism that includes a control ring which has two symmetrical guiding channels on two opposite sides, a first step opening on an upper side and a second step opening formed at one end thereof for housing a control ring spring. Above the upper side of the control ring, there is a clip leg which has a round strut in the center to engage with the first step opening and two symmetrical latch lugs at two sides facing each other engaging with the guiding channels thereby to overcome the poor elastic and unstable conditions of the integrated forming plastic control ring.

To attain the foregoing objects, the control mechanism of the invention consists of a lower grip, an upper grip, a pushbutton, a control ring, a lower runner, a control means, and a center rod. The lower grip has a closed end and a cavity formed inside. In the cavity, there is a hollow anchor body which is spaced from the interior wall of the cavity and forms a gap therebetween. The upper grip is housed in the cavity of the lower grip and held in the gap, and has a button hole formed on an upper side thereof for housing the pushbutton. The pushbutton has a latch stub located on the bottom wall thereof. The control ring is located at one end of the upper grip and has two symmetrical guiding channels on two opposite sides, a first step opening on an upper side and a second step opening formed at one end thereof for housing a control ring spring. Above the upper side of the control ring, there is a clip leg which has a round strut in the center to engage with the first step opening and two symmetrical latch lugs at two sides facing each other engaging with the guiding channels. The lower runner is located at another end of the upper grip and has two symmetrical square slots formed on two opposing side walls, a third step opening formed at one end thereof for housing a lower runner spring and a sleeve, and a square opening formed on a lower wall thereof to engage with the latch stub of the pushbutton. The sleeve has two sleeve lugs at two sides to engage with the square slots of the lower runner. The center rod is mounted in the hollow anchor body of the lower grip and has an extension spring and a latch element located inside, and with the control means located in the front end thereof. The control ring, besides the two symmetrical guiding channels on two opposite sides, also has two symmetrical fingers extending outwards from two sides thereof in opposite directions.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
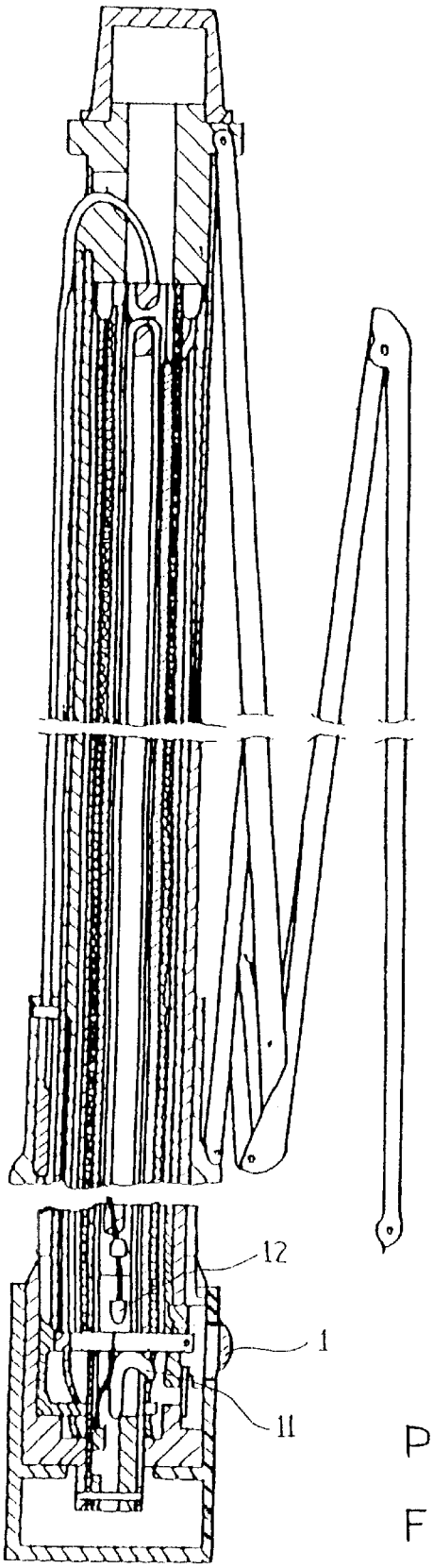
PRIOR ART FIG. 1
FIG. 1 is a schematic view of a conventional jump umbrella.
Figure 2:
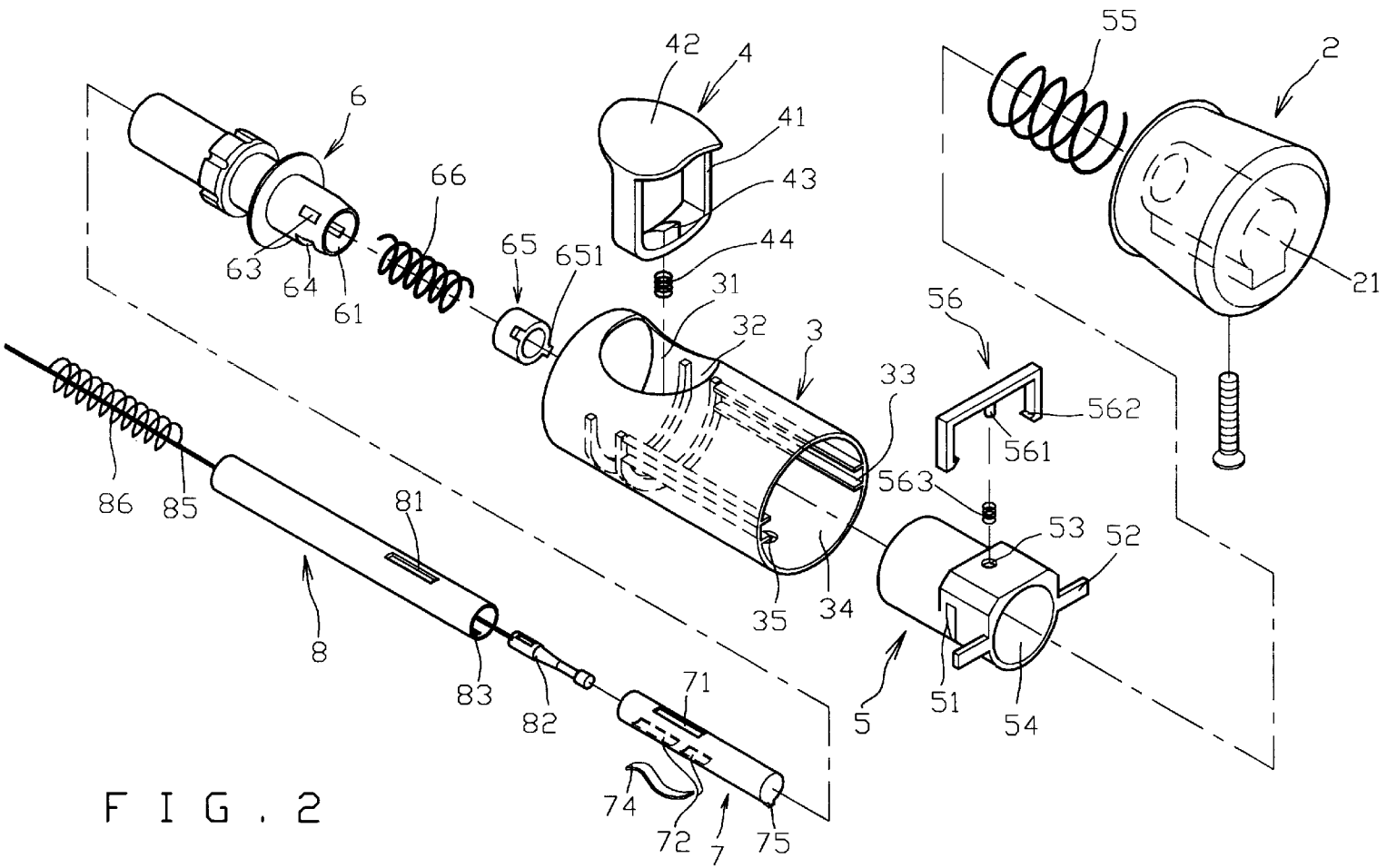
FIG. 2 is an exploded view of the invention.

Referring to FIG. 2, the invention consists of a lower grip 2, an upper grip 3, a pushbutton 4, a control ring 5, a lower runner 6, a control means 7, and a center rod 8.

Figure 3:
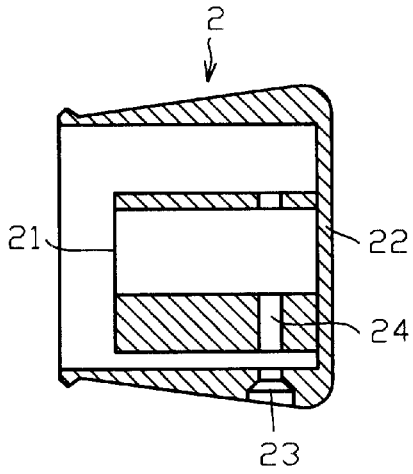
FIG. 3 is a cross section of a lower grip of the invention.

Referring to FIG. 3, the lower grip 2 has a closed end 22 and a cavity formed inside. In the cavity, there is an anchor body 21 mounted to the closed end 22. The anchor body 21 is formed by a hollow cylindrical member and a rectangular member (as shown in FIG. 2). The wall of the lower grip 2 facing the rectangular member has a first screw bore 23. On one side of the anchor body 21 facing the first screw bore 23, there is a second screw bore 24 for fastening a screw.

As shown in FIG. 2, the upper grip 3 has a through passage inside, a button hole 31 formed on an upper side thereof, an annular anchor channel 32 extending from two edges of the button hole 31, two symmetrical and axial slide channels 33 located on two opposite side walls thereof extending from a first opening end 34 of the upper grip 3 to the rim of the anchor channel 32. The lower side of the upper grip 3 adjacent to the first opening end 34 has an aperture 35 for receiving a screw to engage with the first screw bore 23 of the lower grip 2 for fastening the upper grip 3 to the lower grip 2. The pushbutton 4 is a T-shaped connection member which has two side flanges 41 connecting an upper surface 42 and a latch stub 43 located on a lower side thereof. The latch stub 43 has an indented recess formed therebeneath for anchoring a button spring 44 located below the pushbutton 4. The button spring 44 is used to return the pushbutton 4 to its original position after compression. The pushbutton 4 is installed in the upper grip 3 by sliding the side flanges 41 in the annular anchor channel 32.

Figure 4:
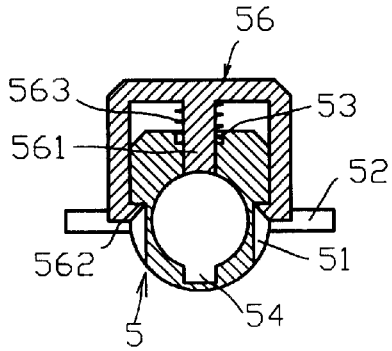
FIG. 4 is a cross section of a control ring coupled with a clip leg.

Referring to FIGS. 2 and 4, the control ring 5 has two symmetrical guiding channels 51 on two sides, two symmetrical square fingers 52 extending outwards from two sides thereof in opposite directions and a first step opening 53 formed on an upper side and a second step opening 54 formed at one end thereof for housing a control ring spring 55 located between the lower grip 2 and control ring 5. Above the upper side of the control ring 5, there is a clip leg 56 which has a round strut 561 in the center to engage with a clip spring 563 and is housed in the first step opening 53. The clip leg 56 further has two symmetrical latch lugs 562 on two inner sides facing each other for engaging with the guiding channels 51 of the control ring 5. The latch lugs 562 are movable up or down on the guiding channels 51. The clip spring 563 may restore the clip leg 56 to its original position. The control ring 5 and clip leg 56 are assembled to become one member.

Figure 5:
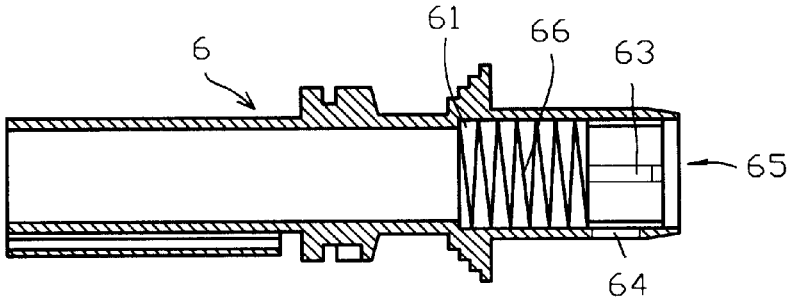
FIG. 5 is a sectional view of a lower runner coupled with a sleeve.

Referring to FIGS. 2 and 5, the lower runner 6 has a third step opening 61 formed at one end thereof, two symmetrical square slots 63 formed on two opposite side walls adjacent to the third step opening 61 and a square opening 64 formed on a lower wall of the same end for engaging with the latch stub 43 of the pushbutton 4. There is a sleeve 65 insertable into the lower runner 6 through the third step opening 61, and a lower runner spring 66 located in the lower runner 6 between the third step opening 61 and sleeve 65. The sleeve 65 has two sleeve lugs 651 at two sides to engage with and slide in the square slots 63 of the lower runner 6.

Referring to FIG. 2, the control means 7 has a first rectangular slot 71 formed on the top wall at one end thereof, two second rectangular slots 72 formed on an outer wall and a round anchor bulge spot formed below the outer wall at the same end for anchoring an elastic latch strip 74 through the second rectangular slot 72. The lower side of another end of the control means 7 has a square anchor strut 75 attached thereon with a screw bore formed in the vicinity thereof. The center rod 8 has an extension spring 86 and a latch element 82 located therein, a third rectangular slot 81 formed on an upper wall thereof matching the first rectangular slot 71 of the control means 7 to allow the round strut 561 of the clip leg 56 to depress the latch element 82. The center rod 8 further has a square opening 83 formed on a lower wall to allow the square anchor strut 75 of the control means 7 moving therein for channeling the direction of the control means 7. The center rod 8 also has a screw bore formed in the vicinity of the square opening 83 matching the screw bore formed on the control means 7. The latch element 82 has one end tied to a pulling cord 85 which has one end passing through a plug located at the front end of the center rod 8 to fasten to the lower runner 6.

Referring to FIGS. 2 through 5, for assembly, first, place the lower runner spring 66 and sleeve 65 in the lower runner 6 with the sleeve lugs 651 engaging with the square slots 63 of the lower runner 6 to become one member; then place the extension spring 86 and latch element 82 into the center rod 8; then place the latch elastic strip 74 into the control means 7 and move the square anchor strut 75 of the control means 7 along the square opening 83 of the center rod 8 to nest the control means 7 in the center rod 8; place the pushbutton 4 with the button spring 44 attached thereunder in the button hole 31 of the upper grip 3; couple the lower runner 6 with the center rod 8 and insert the coupled subassembly of the two through the upper grip 3 and pushbutton 4 to make the square opening 64 of the lower runner 6 matching the latch stub 43 of the pushbutton 4; couple the control ring 5 with the clip spring 563 and clip leg 56 to become one member, and place the control ring 5 in the rear end of the upper grip 3, and place the control spring 55 in the second step opening 54 of the control ring 5; then insert the upper grip 3, center rod 8 and control means 7 into the lower grip 2, fasten the upper grip 3, center rod 8 and control means 7 in the lower grip 2 by engaging a screw through a first screw bore 23 of the lower grip 2, aperture 35 of the upper grip 35, and screw bores on the center rod 8 and control means 7. Thus complete the assembly of the invention.

Figures 6A, 6B:
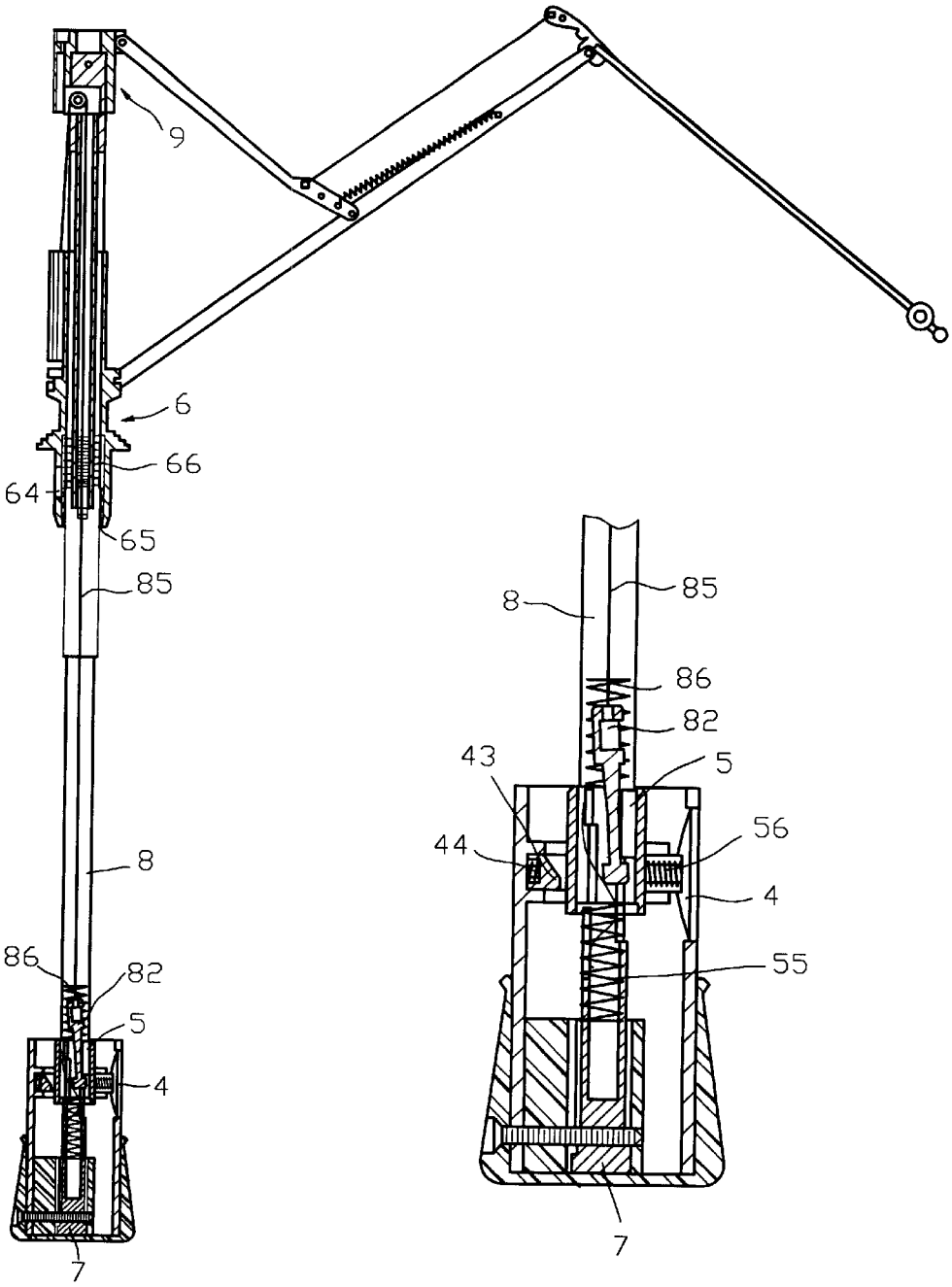
FIG. 6A is a sectional view of the invention, with the umbrella fully extended.
FIG. 6B is a fragmentary sectional view of the invention, according to FIG. 6A.
Figure 8:
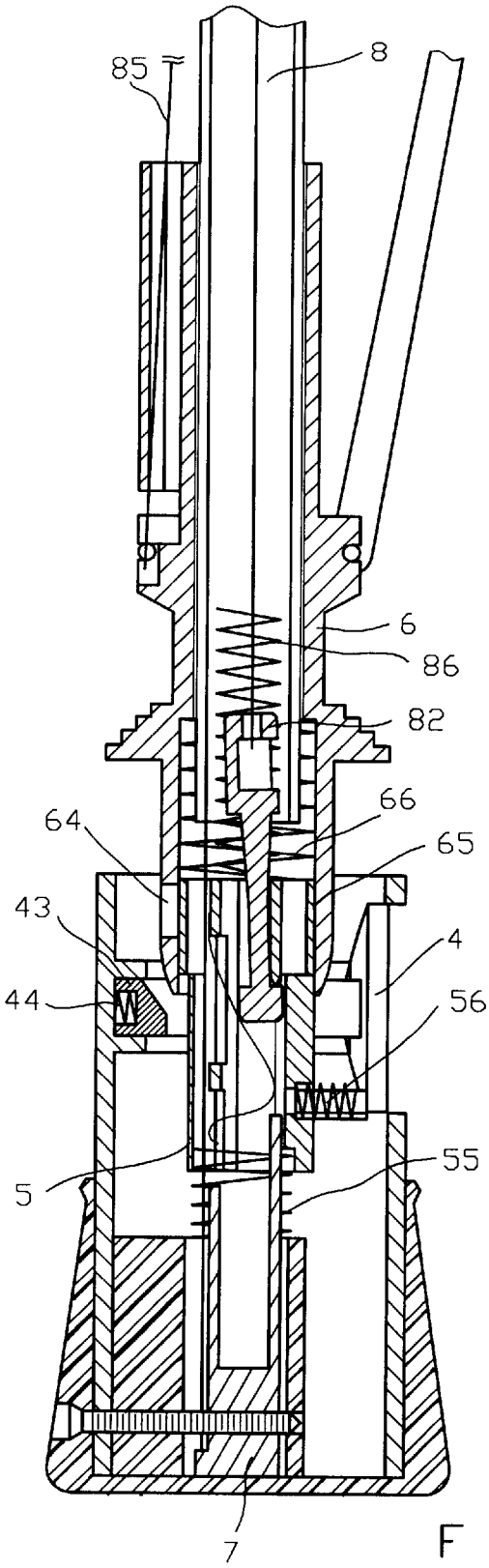
FIG. 8 is a sectional view of the invention, with the umbrella extending instantaneously.

Referring to FIGS. 6A, 6B and 8 for fully extending or instantaneously extending the umbrella, depress the pushbutton 4, the button spring 44 will be compressed and push the square opening 64 of the lower runner 6 away from the latch stub 43, the center rod 8 will be moved for a selected distance towards the direction of an upper runner 9. Under such a condition, if the tie band of the umbrella is not yet unfastened, the umbrella frame cannot be extended. The sleeve 65 will be urged by the lower runner spring 66 to push the control ring 5 and control ring spring 55. As the elastic force of the lower runner spring 66 is greater than the control ring spring 55, the clip leg 56 will be prevented to reach the position of the latch element 82, hence even the pushbutton 4 is depressed repeatedly, the umbrella will not be retracted and the umbrella frame will not be fully extended. Therefore, when the umbrella tie band is not unfastened, the umbrella frame will not be extended even the pushbutton 4 is mistakenly triggered. When the umbrella tie band is unfastened, the umbrella will be fully extended, as the latch element 82 is engaged with the control means 7 during the umbrella was retracted previously, the cord 85 will pull the lower runner 6 to the location of the upper runner 9. Under such a circumstance, the clip leg 56 of the control ring 5 will be freed from the influence of the lower runner spring 66 and reaches the position of the latch element 82.

Figure 7:
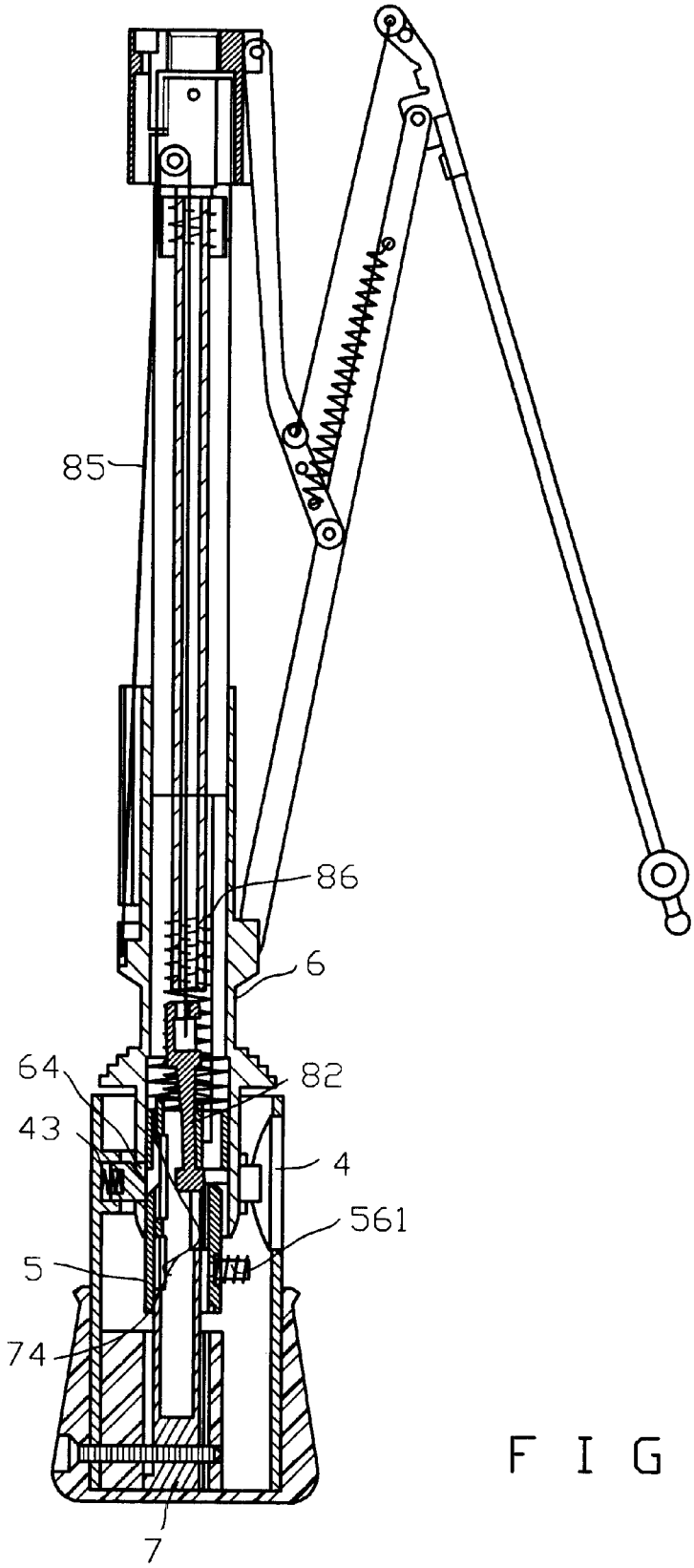
FIG. 7 is a sectional view of the invention, with the umbrella fully retracted.
Figure 9:
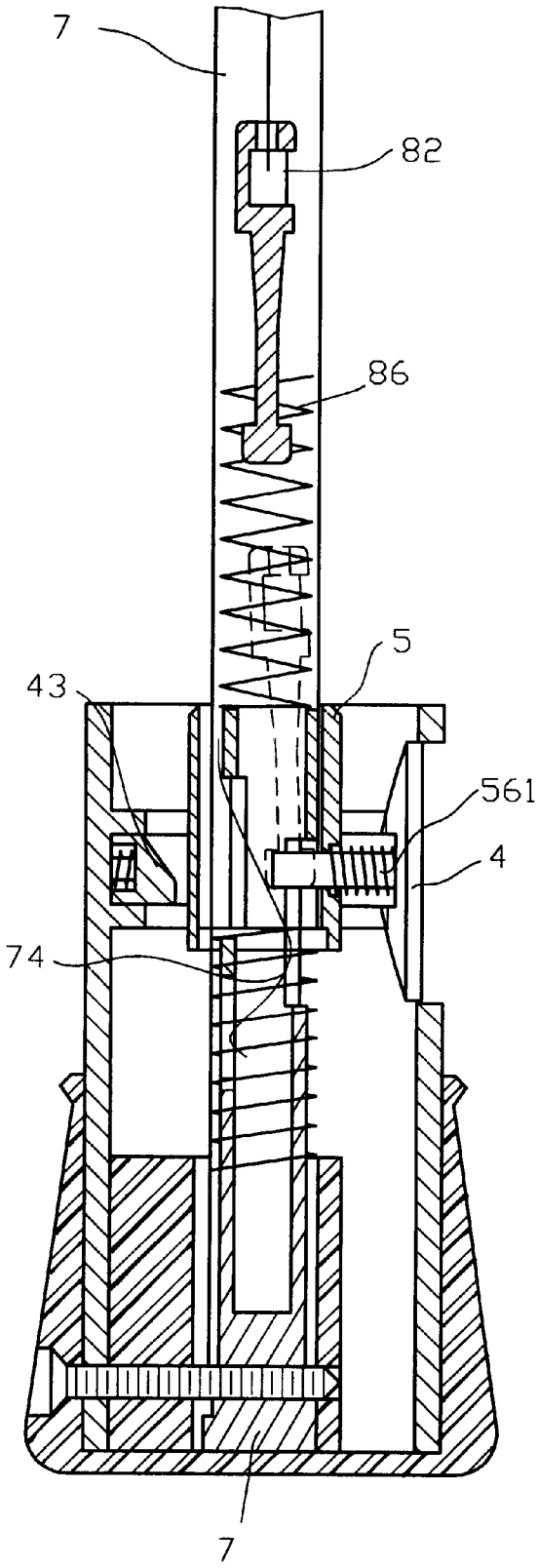
FIG. 9 is a sectional view of the invention, with the umbrella retracting instantaneously.

Referring to FIGS. 7 and 9 for fully or instantaneously retracting the umbrella, as the control ring 5 is moved away from the lower runner 6 and moved to the position of the latch element 82 during the umbrella extension, depress the pushbutton 4, the clip leg 56 of the control ring 5 will be moved downwards and the round strut 561 will depress the latch element 82 downwards. As a result, the latch element 82 will overcome the harness of the elastic latch strip 74 and escape from the control means 7. The umbrella will be retracted under the force of the retracting spring. Compress the upper runner to depress the extension spring 86, the lower runner 6 may be moved to allow the square opening 64 engaging with the latch stub 43 of the pushbutton 4 again. Thus complete one cycle of umbrella extension and retraction.

While the preferred embodiment of the inventions has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A control mechanism for folding jump umbrellas, comprising:

a lower grip having a closed end and a cavity formed therein, the cavity having a hollow anchor body mounted to the closed end, the anchor body being formed a gap with the cavity;

an upper grip insertable in the gap of the lower grip having a button hole formed on an upper side thereof for housing a pushbutton, the pushbutton having a lower surface which has a latch stub formed thereon;

a control ring located at one end of the upper grip having two symmetrical guiding channels on two sides, two symmetrical square fingers extending outwards from two sides at one end thereof in opposite directions, a first step opening formed on an upper side thereof and a second step opening formed at one end thereof for housing a control ring spring, a clip leg located above the upper side of the control ring having a round strut in the center thereof insertable in the first step opening and two symmetrical latch lugs on two inner sides thereof for engaging with the guiding channels of the control ring;

a lower runner located at another end of the upper grip having a third step opening formed at one end thereof to house a lower runner spring and a sleeve, two symmetrical square slots formed on two opposing side walls thereof and a square opening formed on a lower wall of the one end thereof for engaging with the latch stub of the pushbutton; and a center rod inserted in the hollow anchor body of the lower grip having an extension spring and a latch element located therein, and a front end housing a control means.

2. The control mechanism for folding jump umbrellas of claim 1, wherein the anchor body consists of a hollow cylindrical member and a rectangular member.

3. The control mechanism for folding jump umbrellas of claim 1, wherein the latch stub has an indented recess formed therebeneath for anchoring a button spring to return the pushbutton to its original position after compression.

4. The control mechanism for folding jump umbrellas of claim 1, wherein the upper grip has a button hole formed on an upper side thereof, and an annular anchor channel extending from two edges of the button hole, the pushbutton having two side flanges slidable in the annular anchor channel.

5. The control mechanism for folding jump umbrellas of claim 1, wherein the upper grip has two symmetrical and axial slide channels located on two opposite side walls thereof for slidably coupling with the two symmetrical square fingers of the control ring to guide the moving direction of the control ring in the upper grip.

6. The control mechanism for folding jump umbrellas of claim 1, wherein the round strut of the clip leg engages with a clip spring for restoring the clip leg after compression.

7. The control mechanism for folding jump umbrellas of claim 1, wherein the latch lugs of the clip leg are movable up or down on the guiding channels of the control ring.

8. The control mechanism for folding jump umbrellas of claim 1, wherein the third step opening of the lower runner restricts the lower runner spring moving in only one direction.

9. The control mechanism for folding jump umbrellas of claim 1, wherein the sleeve lugs of the sleeve are slidable in the square slots of the lower runner.

10. The control mechanism for folding jump umbrellas of claim 1, wherein the latch element has one end tied to a pulling cord which has another end passing through a plug located at a front end of the center rod to fasten to the lower runner.

11. The control mechanism for folding jump umbrellas of claim 1, wherein the control means has a first rectangular slot formed on an upper wall adjacent to one end thereof, two second rectangular slots formed on an outer wall and a round anchor bulge spot formed below the outer wall at the one end for anchoring an elastic latch strip through the first rectangular slot.

12. The control mechanism for folding jump umbrellas of claim 1, wherein the center rod has a third rectangular slot formed on an upper wall thereof matching the first rectangular slot of the control means to allow the round strut of the clip leg to depress the latch element.

13. The control mechanism for folding jump umbrellas of claim 1, wherein the control means has one end formed a square anchor strut, the center rod having a square opening formed on a lower wall thereof to allow the square anchor strut of the control means moving therein for channeling the direction of the control means in the center rod.

14. The control mechanism for folding jump umbrellas of claim 1, wherein the lower runner spring has an elastic force greater than that of the control ring spring.

15. The control mechanism for folding jump umbrellas of claim 5, wherein the slide channels of the upper grip has a length equal to the distance from the first opening end of the upper grip to the rim of the annular anchor channel.

* * * * *